US010822777B2

(12) United States Patent
Dieterle et al.

(10) Patent No.: US 10,822,777 B2
(45) Date of Patent: Nov. 3, 2020

(54) SANITARY FITTING COMPRISING A WATER CONDUIT CHANNEL

(71) Applicant: Hansgrohe SE, Schiltach (DE)

(72) Inventors: Daniel Philipp Dieterle, Wolfach-Kirnbach (DE); Ulrich Kinle, Schenkenzell (DE); Fabian Melle, Durbach (DE); Michael Skrypski, Schramberg (DE); Markus Wöhrle, Schiltach (DE)

(73) Assignee: Hansgrohe SE, Schiltach (DE)

( * ) Notice: Subject to any disclaimer, the term of this patent is extended or adjusted under 35 U.S.C. 154(b) by 0 days.

(21) Appl. No.: 16/104,797

(22) Filed: Aug. 17, 2018

(65) Prior Publication Data

US 2019/0055721 A1 Feb. 21, 2019

(30) Foreign Application Priority Data

Aug. 21, 2017 (DE) ..... 10 2017 214 571

(51) Int. Cl.
*E03C 1/04* (2006.01)
*E03C 1/084* (2006.01)
(Continued)

(52) U.S. Cl.
CPC ..... *E03C 1/0404* (2013.01); *E03C 1/08* (2013.01); *E03C 1/084* (2013.01); *E03C 1/046* (2013.01)

(58) Field of Classification Search
CPC ..... E03C 1/0404; E03C 1/08; E03C 1/084; E03C 1/046
(Continued)

(56) References Cited

U.S. PATENT DOCUMENTS 7,878,426 B2 2/2011 Denzler
8,191,799 B2 * 6/2012 Chen ..... B05B 1/18 239/428.5
(Continued)

FOREIGN PATENT DOCUMENTS

CN 1360479 A 7/2002
CN 102061726 A 5/2011
(Continued)

OTHER PUBLICATIONS

European Search Report issued by the European Patent Office, Munich, Germany, dated Jan. 22, 2019 for European Patent Application No. 18188363.8.
(Continued)

*Primary Examiner* — Steven J Ganey
(74) *Attorney, Agent, or Firm* — Faegre Drinker Biddle & Reath LLP

(57) ABSTRACT

A sanitary fitting including a water conduit channel. The sanitary fitting illustratively further includes an insertion duct extending into the water conduit channel and including a user-accessible insertion opening, and an insertion plate including at least one sanitary utility element and exhibiting, in a flow-through region in which the plate has flow-through capability from its one plate main side (H1) to its other plate main side (H2), a smaller plate thickness (PD) as compared to its lateral plate dimension (PL), the insertion plate being insertable in a lateral insertion direction (SL) into the insertion duct via the insertion opening and extractable from the insertion duct counter the insertion direction. The insertion duct remains stationary in an operating position, when the insertion plate is inserted or extracted, and the insertion opening remains user-accessible in the stationary operating position of the insertion duct.

14 Claims, 11 Drawing Sheets

(51) Int. Cl.
*E03C 1/08* (2006.01)
*E03C 1/046* (2006.01)

(58) Field of Classification Search
USPC ..... 239/208, 209, 419.5, 428.5, 282, 283, 239/548, 550, 556, 557, 600
See application file for complete search history.

(56) References Cited

U.S. PATENT DOCUMENTS

| | | | | |
|---|---|---|---|---|
| 9,534,362 | B2 | 1/2017 | Städtler | |
| 2005/0072722 | A1 | 4/2005 | Takagi | |
| 2005/0072727 | A1 | 4/2005 | Takagi et al. | |
| 2005/0224406 | A1 | 10/2005 | Takagi et al. | |
| 2007/0194153 | A1* | 8/2007 | Frazee | E03C 1/08 239/428.5 |
| 2009/0224067 | A1 | 9/2009 | Grether et al. | |
| 2011/0036930 | A1 | 2/2011 | Denzler et al. | |
| 2012/0055886 | A1 | 3/2012 | Hunter | |
| 2012/0055888 | A1 | 3/2012 | Hunter | |
| 2015/0292660 | A1 | 10/2015 | Mathews et al. | |
| 2017/0239680 | A1 | 8/2017 | Hunter | |

FOREIGN PATENT DOCUMENTS

| | | | |
|---|---|---|---|
| CN | 102401164 | A | 4/2012 |
| CN | 202298777 | U | 7/2012 |
| DE | 1209515 | B | 1/1966 |
| DE | 102005003404 | B3 | 9/2006 |
| DE | 102008012388 | A1 | 9/2009 |
| DE | 102006062983 | B3 | 2/2015 |
| GB | 2445736 | A | 7/2008 |
| RU | 2442860 | C2 | 2/2012 |
| WO | 2006084448 | A1 | 8/2006 |

OTHER PUBLICATIONS

Decision to Grant issued by the Federal Service for Intellectual Property, Patents and Trademarks (ROSPATENT), dated Jun. 4, 2019, for Russian Patent Application No. 2018129467/10(047553).
Examination Report issued by the German Patent and Trademark Office, dated Jul. 11, 2018, for related Application No. 102017214571.4; 6 pages.
English translation of the Text of First Office Action and Office Action (in Chinese language), issued by the China National Intellectual Property Administration, dated Mar. 2, 2020 for Chinese Patent Application No. 2018109555386.

* cited by examiner

SANITARY FITTING COMPRISING A WATER CONDUIT CHANNEL

CROSS-REFERENCE TO RELATED APPLICATION

This application claims priority to German Patent Application No. DE 10 2017 214 571.4, filed on Aug. 21, 2017, the disclosure of which is expressly incorporated herein by reference.

BACKGROUND AND SUMMARY OF THE DISCLOSURE

The present invention relates generally to a sanitary fitting and, more particularly to a sanitary fitting including a water conduit channel, an insertion duct transversely extending into the water conduit channel and including a user-accessible insertion opening, and an insertion body which includes at least one sanitary utility element, has flow-through capability in a flow-through region from one side to an opposing side, and is insertable into the insertion duct and extractable from the insertion duct. The insertion duct remains stationary in an operating position, when the insertion body is inserted or extracted, and the insertion opening remains user-accessible in the stationary operating position of the insertion duct. The insertion body has its flow-through region positioned in the water conduit channel and the utility element is in contact with the water conduit channel, when the insertion body is located in its operating position completely inserted in the insertion duct, and at least one sanitary utility element that is introducible into the water conduit channel in a removable manner.

The sanitary fitting can otherwise be of any desired type. This includes, inter alia, sanitary fittings in the form of shower spray devices mounted to a wall or ceiling, hand showers for bathtubs and shower rooms, and water outflow fittings for washstands, kitchen sinks and the like.

For sanitary water outflow fittings, for example mixer fittings on washstands, bathtubs and kitchen sinks, it is known to attach typically cylindrical insertion bodies having utility elements in the form of perlators, jet regulators, jet formers or sieves to a water outlet of an outlet housing body of the sanitary fitting by means of a releasable screw connection, such that, if necessary, the insertion body can be removed and maintained or replaced with a new utility element.

The patent publication DE 10 2006 062 983 B3 discloses as an insertion body a cuboid-shaped jet regulator body having rounded side edges which is insertable from an outflow end side into a water outflow of a sanitary fitting and can be fastened releasably in the water outflow. The jet regulator body has a jet regulator housing comprising a circumferential insertion opening and an insertion conduit, oriented transversely to a longitudinal axis of the jet regulator, for inserting at least one insert part, wherein the insert part has for example a preferably jet forming sieve, lattice or mesh structure. In order to insert and remove the insert part, the jet regulator body has to be removed from its operating position in the water outflow.

Similarly, a sleeve-like insert cartridge is disclosed in the laid-open publication DE 10 2008 012 388 A1, the insert cartridge containing a jet former, and is insertable into a tubular fitting outflow from the end side thereof, wherein this insert cartridge has an end-side water inflow and a circumferential water outflow.

The patent publication DE 10 2005 003 404 B3 discloses a sanitary outflow fitting comprising an unaerated cylindrical jet regulator body threaded into the water outflow, and comprising an aeration device, spaced apart upstream thereof, which can be embodied as a cylindrical insert cartridge and can be inserted releasably into a corresponding insertion opening of a fitting housing and to this end opens out in a sleeve-like cartridge receptacle.

The patent publication WO 2006/084448 A1 discloses a sanitary water outflow fitting such as a single-lever mixer, having a main body and a tubular water outflow, wherein the water outflow comprises a half-shell-like connecting member, which is arranged on the main body on the entry side and bears a pivotable outflow head on the exit side, and a replaceable unit of cylindrical shape, which can be inserted releasably into the half-shell shape of the connecting member and contains a water treatment means as a sanitary utility element, for example a filter unit, an ion exchange material or an antimicrobial protection device.

The patent publication DE 1 209 515 discloses a sanitary fitting of the type mentioned at the outset in the form of a water outlet fitting where the insertion duct is formed by a tube sleeve which traverses an outlet tube and is provided with peripheral openings for allowing water passing through, and which protrudes with an open face side beyond a wall of the outlet tube. A cylindrical aeration and jet regulator insert is used as an insertion body which can be inserted into the tube sleeve. A cylindrical closure plug seals the tube sleeve to the outside and comprises a cavity leading to an axial air suction opening.

It is an object of the invention to provide a sanitary fitting of the type mentioned at the beginning which comprises an advantageously formed insertion body equipped with at least one exchangeable sanitary utility element.

The invention achieves this and other objects by providing a sanitary fitting which illustratively comprises a water conduit channel, an insertion duct transversely extending into the water conduit channel and including a user-accessible insertion opening, and an insertion body which includes at least one sanitary utility element, has flow-through capability in a flow-through region from one side to an opposing side, and is insertable into the insertion duct and extractable from the insertion duct. The insertion duct remains stationary in an operating position, when the insertion body is inserted or extracted, and the insertion opening remains user-accessible in the stationary operating position of the insertion duct. The insertion body has its flow-through region positioned in the water conduit channel and the utility element is in contact with the water conduit channel, when the insertion body is located in its operating position completely inserted in the insertion duct.

The insertion body is illustratively formed as an insertion plate which has flow-through capability in its flow-through region from its one plate main side (H1) to its other plate main side and has a smaller plate thickness as compared to its lateral plate dimension and is insertable in a lateral insertion direction into the insertion duct and extractable from the insertion duct counter the insertion direction. The insertion direction thus extends along a lateral, i.e. transverse, direction of the insertion plate and transverse to a direction along which the water conduit channel extends in the region where the insertion duct extends transversely into the water conduit channel.

Consequently, in this sanitary fitting according to an illustrative embodiment of the invention, when the sanitary fitting is in its operating position, for example mounted as a mixer fitting on a washstand, a kitchen sink or a tub region, or mounted to a wall or ceiling as an overhead or side shower fitting in a bathroom or shower room, the sanitary utility element can be moved into the desired position in the water conduit channel very easily by inserting the insertion plate via the user-accessible insertion opening into the insertion duct and removed again if necessary, without the sanitary fitting as a whole having to be disassembled and without a part, containing the insertion duct, of the sanitary fitting having to be disassembled or taken off or removed from another fitting part for this purpose. This facilitates associated maintenance work in which the utility element has to be removed from the water conduit channel in order to insert it again for example after cleaning or to replace it with a new utility element. Similarly, any exchange of the utility element for a utility element of some other type is facilitated. A thread for attaching the utility element in a screwable manner is also not necessary. In addition, no tools are absolutely necessary for attaching and removing the sanitary utility element.

At least in its flow-through region, the dimension of the illustrative insertion plate is smaller in the thickness direction than transversely thereto, i.e. smaller than in the lateral directions perpendicular thereto. The insertion plate can in this case be realized in particular in the manner of a service card with a comparatively flat design in the flow-through direction, wherein the thickness dimension in the flow-through direction is for example only about one-third (⅓), or one-fourth (¼), or one-fifth (⅕) of the dimension in the direction perpendicular thereto, or even less, i.e. the thickness of the insert plate is then at most about one-third (⅓), one-fourth (¼), or one-fifth (⅕) or even less in relation to the minimum dimension of the insertion plate in the transverse direction. Such a realization as a service card allows the insertion plate to be used in sanitary fittings of comparatively flat construction, such as plate-like overhead showers in shower rooms. In advantageous realizations, the insertion plate has a rectangular or square shape, e.g. having a cuboid outer dimension, in an alternative configuration any desired other shape, such as circular or oval, etc. The insertion duct comprises a corresponding form, such as rectangular or a cuboid-like hollow shape or circular etc.

In an illustrative embodiment of the invention, the sanitary utility element is a sieve or a flow limiter or a jet forming body or a water aerator element or a water additive element. The sieve can be used to retain disruptive particles. This can be advantageous for example for showers, which have relatively small shower jet exit openings that are therefore susceptible to being clogged by particles in the stream of water. The flow limiter can be used to set the flow-through of water through the water conduit channel in a desired manner. The jet forming body can be used to provide a desired jet pattern for the water emerging from the sanitary fitting. The water aerator element can be used to aerate the water guided through the water conduit channel, i.e. to enrich it with supplied air. The water additive element can be used to admix an additive with the water guided in the water conduit channel, for example a detergent, a shower soap or some other showering additive.

In an illustrative embodiment of the invention, the insertion plate comprises in its thickness dimension in the flow-through direction a wedge shape with decreasing thickness in the insertion direction, and comprises a seal at an inclined surface corresponding to the wedge shape. The insertion of the insertion plate into the insertion duct thus ensures that the necessary contact pressure of the seal arises only in the final part of the travel, i.e. shortly before the insertion plate has reached its operating position in the insertion duct. It is advantageous here that the seal is not damaged during the insertion of the insertion plate into the insertion duct and the necessary force during insertion remains low.

In an illustrative embodiment of the invention, the sanitary fitting has a releasable latching mechanism for holding the insertion plate in the insertion duct in a latched manner. This represents an advantageous possibility of keeping the insertion plate in its operating position in the insertion duct and if necessary removing it from the insertion duct by releasing the latching mechanism.

In an illustrative embodiment of the invention, the sanitary fitting has a water stop mechanism for the automatic opening and closing of the water conduit channel during the insertion of the insertion plate into the insertion duct and removal therefrom. As a result, the water conduit channel can be closed or shut off automatically when the insertion plate is removed from the insertion duct. This avoids undesired emergence of water for example from the insertion duct without the user themselves having to actuate a shut-off member for this purpose. As a result of the insertion plate being inserted into the insertion duct, the water stop mechanism automatically opens the water conduit channel, such that again there is no need for separate actuation of a shut-off member by the user in order to open the water conduit channel.

In an illustrative embodiment of the invention, the sanitary fitting has an ejection mechanism for the automatic extraction of the insertion plate from its operating position in the insertion duct following releasing of the latching mechanism. The ejection mechanism ensures that, when the user has released the latching mechanism, the insertion plate is extracted at least a little way out of its operating position in the insertion duct, after which the user can remove the insertion plate completely from the insertion duct if required.

In an illustrative embodiment of the invention, the water stop mechanism includes a closure slider unit, which is elastically biased in the closing direction and is actuated by the insertion plate, for opening and closing the water conduit channel upstream of the insertion duct. This makes it possible to reliably shut off the water conduit channel relatively easily with the insertion plate not inserted.

In an illustrative embodiment of the invention, the sanitary fitting has a clip mechanism for holding the utility element on the insertion plate in a clipped manner. By way of the clip mechanism, the utility element can be held securely on the insertion plate, with the result that there is no risk of the utility element falling out of the insertion plate when the insertion plate is handled. If required, the clip mechanism can be realized in a non-releasable manner and/or in a manner secured against unauthorized use. As a result, the insertion plate can be secured against unauthorized manipulation, if required.

In an illustrative embodiment of the invention, the insertion plate comprises a plurality of utility elements, which are arranged in juxtaposition in a plate plane of the insertion plate or are arranged in succession in a flow-through direction perpendicular thereto. Utility elements arranged in juxtaposition preferably have respective partial streams of the water flowing in the water conduit channel flowing through them in a parallel manner in terms of flow. Utility elements arranged in succession preferably have water flowing in the water conduit channel flowing through them serially in terms of flow.

In an illustrative embodiment of the invention, the sanitary fitting is water outflow fitting having a housing body on which the insertion duct is disposed. The insertion duct is in this case integrated into the housing body of the sanitary fitting, wherein the water conduit channel extends in the housing body. In corresponding configurations, the housing body forms an outlet body with a water outlet from which the water exits in order to be used by the user.

In an illustrative embodiment development of the invention the insertion plate has a rear face side ending flush with the housing body of the water outlet fitting when the insertion plate is in its operating position completely inserted into the insertion duct. This allows a visually unobtrusive integration of the insertion plate into the design of the housing body of the water outlet fitting.

In an illustrative embodiment of the invention, the sanitary fitting is a shower spray device mounted in a projecting manner to a wall or ceiling, having a shower head housing on which the insertion duct is disposed. In this case, the shower spray device forms a water outlet fitting and the shower head housing forms an associated housing body. The shower spray device is mountable to a wall or ceiling region of a shower room or bathroom, wherein it projects at least with its shower head housing from the wall or ceiling region. Since the insertion duct is disposed on the shower head housing, the insertion plate can be readily accessible with the one or more utility elements and be inserted into the insertion duct or removed therefrom with a relatively small upstream spacing from a water outlet of the shower spray device, said water outlet typically being formed by a jet disc that closes the shower head housing downstream.

In an illustrative embodiment of the invention, the sanitary fitting is a shower spray device built into a wall or ceiling, and the insertion duct is disposed with an insertion direction oriented perpendicularly to a wall or ceiling installation plane. The shower spray device is in this case flush with a wall or ceiling region of a shower room or bathroom or is built into same in a recessed manner, without projecting from this wall or ceiling region. Since the insertion duct is disposed with an insertion direction oriented perpendicularly to the wall/ceiling installation plane, the insertion plate can nevertheless be introduced very easily in order to put the utility element(s) into their use position in the water conduit channel. As a result, a surface-mounted component is not required for inserting the insertion plate for such a shower spray device built into a wall or ceiling.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

A detailed description of the drawings particularly refers to the accompanying figures, in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
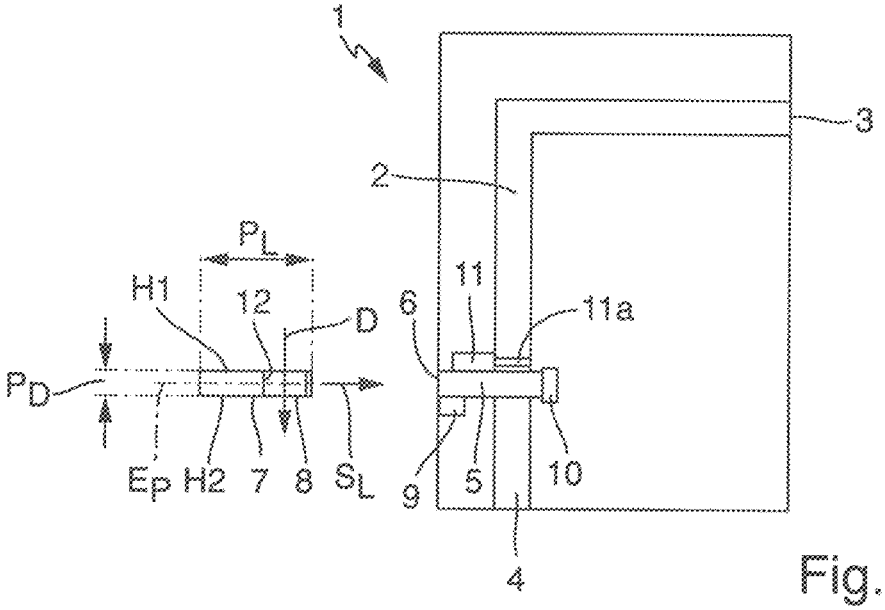
FIG. 1 shows a block diagram illustration of a sanitary fitting according to an illustrative embodiment of the invention.

FIG. 1 shows, in block diagram form, a sanitary fitting 1 which has a water conduit channel 2, which extends from a water inlet 3 to a water outlet 4 of the sanitary fitting 1. Furthermore, the sanitary fitting 1 has an insertion duct 5 with an insertion opening 6. The insertion duct 5 extends into the water conduit channel 2. For example, the insertion duct 5 can be disposed in a housing part of the sanitary fitting 1, the water conduit channel 2 also being disposed therein at least in its portion adjacent to the insertion duct 5.

The sanitary fitting 1 furthermore comprises an insertion body in the form of an insertion plate 7, which contains at least one sanitary utility element 8 and has, at least in a flow-through region, a smaller plate thickness PD as compared to its lateral plate dimension PL. In this case, the lateral plate dimension PL can be for example the length or width of a rectangular configuration of the insertion plate 7 or the diameter of a circular configuration of the insertion plate 7 or the minimum lateral extent of an oval, polygonal or other configuration of the insertion plate 7. The lateral direction should be understood here as meaning, as usual, the directions parallel to the plate plane, wherein the plate plane means, as usual, a central plane EP of the insertion plate 7 or a plane parallel thereto, to which its two plate main sides, i.e. its upper main side H1 in FIG. 1 and its lower main side H2 in FIG. 1, are parallel or extend at all events at an acute angle or at most 45°. Preferably, the plate thickness PD is at most ⅕ of the lateral plate dimension PL.

The insertion plate 7 is insertable into the insertion duct 5 in a lateral insertion direction SL via the insertion opening 6 and extractable from the insertion duct counter to the insertion direction. The insertion duct 5 is arranged in a stationary manner, i.e., during operation of the sanitary fitting 1, it adopts an operating position in which it remains even when the insertion plate 7 is inserted or extracted. The insertion opening 6 remains user-accessible in the stationary operating position of the insertion duct 5. Therefore, the insertion duct 5 does not have to be disassembled or moved in some other way in order to insert and extract the insertion plate 7.

In FIG. 1, the insertion plate 7 is shown completely outside the insertion duct 5. In the operating position, the insertion plate 7 is inserted completely into the insertion duct 5 and is located with its flow-through region in the water conduit channel 2, such that it is able to have water flowing through it from its one (first) plate main side H1 to its opposing other (second) plate main side H2, i.e. along its plate thickness PD, when water flows in the water conduit channel 2. This is symbolized in FIG. 1 with a flow-through direction D perpendicular to the central plane EP of the insertion plate 7. In this case, the flow-through can also take place at an angle to the central plane EP or in a winding manner, as long as the water flowing in the water conduit channel 2 enters the insertion plate 7 on one plate main side H1 and exits again on the other plate main side H2 facing away therefrom. Depending on requirements and the application, flow can take place through the insertion plate 7 as a whole, or the flow-through region forms only a subregion of the insertion plate 7. In this operating position, the utility element 8 is in contact with the water conduit channel 2, such that water flows through the latter or alternatively has only incident flow or comes into contact therewith.

The sanitary utility element 8 can be any desired element that is usable with such an insertion plate and fulfils an associated useful sanitary function for the sanitary fitting or the water guided in the water conduit channel 2. For example, the utility element 8 can be a sieve or a flow limiter or a jet forming body or a water aerator element or a water additive element. A sieve can be used to retain disruptive particles in the stream of water. A flow limiter can be used to limit the water flow rate in a desired manner. A jet forming body can ensure that the water exits the water outlet 4 of the sanitary fitting 1 with a desired jet shape. A water aerator element can be used to admix air with the stream of water in the water conduit channel 2. A water additive element can be used to admix an additive with the water in the water conduit channel 2, for example a detergent, soap or some other additive, depending on the use purpose of the sanitary fitting.

FIG. 1 also shows several optional parts which may or may not be present in corresponding realizations of the sanitary fitting according to the invention, depending on requirements and the application. Where reference is not explicitly made in the following text to functional relationships of these optional parts, a person skilled in the art will clearly understand that there are no functional relationships between these optional parts and, depending on requirements and the application, these parts can therefore be present on their own or in any desired combination in corresponding realizations of the sanitary fitting according to the invention.

This relates for example to an optional, releasable latching mechanism 9 for holding the insertion plate 7 in the insertion duct 5 in a latched manner. Thus, the insertion plate 7 can be held securely in the insertion duct 5 and, if required, be removed from the insertion duct 5 again by releasing the latching mechanism 9. In addition, an ejection mechanism 10 for automatically extracting the insertion plate 7 from its operating position in the insertion duct 5 following releasing of the latching mechanism 9 can optionally be provided. For the latching mechanism and for the ejection mechanism, any desired conventional types are usable in each case, as are known per se for example also in similar plate/card receptacle systems, such as in memory card, bank card and SIM card systems.

Optionally, the sanitary fitting 1 can also comprise a water stop mechanism 11 for automatically opening and closing the water conduit channel 2 when the insertion plate 7 is inserted into the insertion duct 5 and removed therefrom. This prevents water from unintentionally exiting the water conduit channel 2, for example via the insertion duct 5, when the insertion plate 7 is removed from the insertion duct 5. In this case, it may be advantageous, in corresponding embodiments, for the water stop mechanism 11 still to allow the exit of a defined quantity of water and to not completely shut off the water conduit channel 2. In this way, the lack of the insertion plate 7 can be indicated. For the water stop mechanism 11, any desired type that is known per se for this purpose is usable. In a corresponding configuration, the water stop mechanism 11 can have for example a closure slider unit 11*a*, which is elastically biased in the closing direction and is actuated by the insertion plate 7, for opening and closing the water conduit channel 2 upstream of the insertion duct 5.

The sanitary fitting according to the invention can also optionally have a clip mechanism 12 for holding the utility element 8 on the insertion plate 7 in a clipped manner. The clip mechanism 12 can be of any conventional type and, depending on requirements, can be realized so as to be releasable in an unsecured manner or alternatively non-releasable or alternatively again releasable only for authorized users. In the first case, the utility element can be removed from the insertion plate 7 by any user by releasing the clip mechanism. In the second case, the utility element cannot be removed from the insertion plate 7 without being destroyed.

Structurally, the sanitary fitting 1 in FIG. 1 is able to be embodied in any desired conventional fitting type, for example as a wall- or ceiling-mounted overhead shower or as a side shower or hand shower for shower and bathtub devices, as a washstand mixer, as a bathtub mixer, as a kitchen sink mixer, for example also in the form of a kitchen pull-out shower, or as any other sanitary water outflow fitting, which serves as an interface of a water supply to the user, i.e. has an outflow from which water exits in order to be used by the user. A number of possible structural configurations of the sanitary fitting according to the invention in FIG. 1 will be discussed in the following text with reference to the rest of the figures, wherein these configurations should be understood as being merely by way of example and representative of numerous other possible realizations of the sanitary fitting according to the invention.

Figure 3:
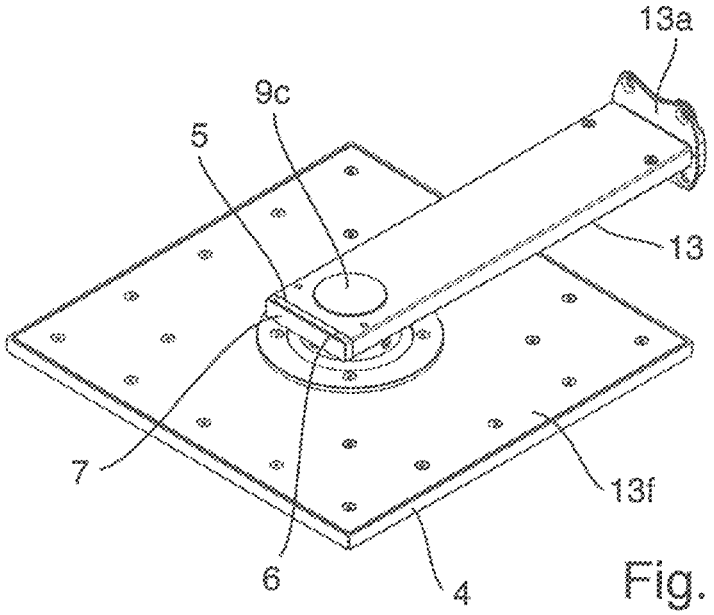
FIG. 3 shows a perspective view of a front part of the overhead shower from FIG. 2 with the shower head mounted.
Figure 2:
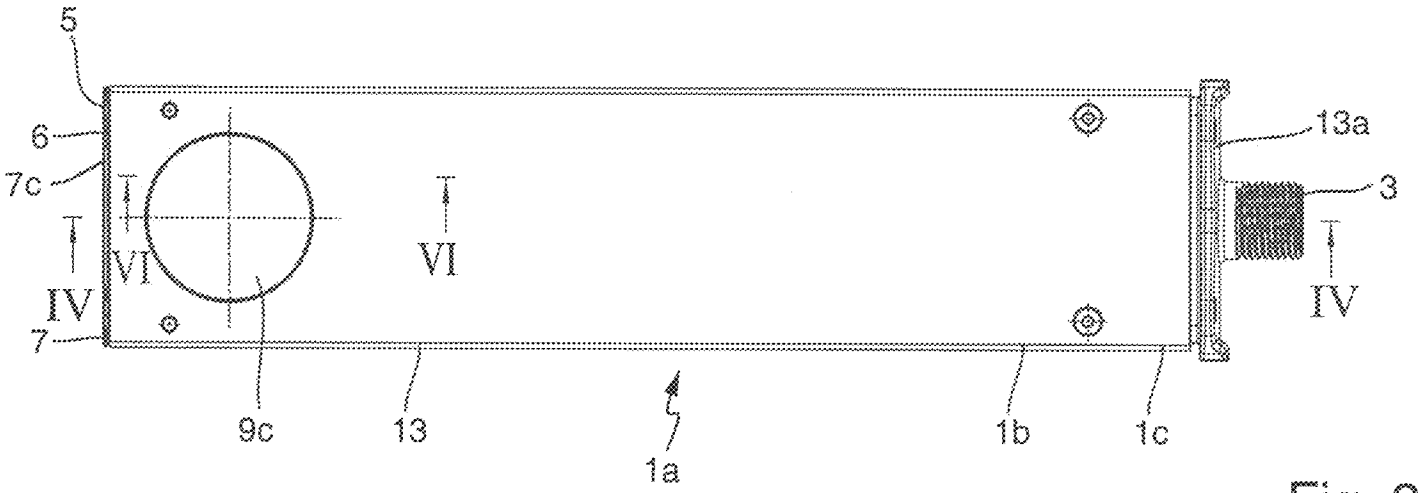
FIG. 2 shows a plan view from above of an illustrative application of the sanitary fitting from FIG. 1 as a wall-mounted overhead shower having an insertion plate inserted in the operating position and the shower head removed.
Figure 4:
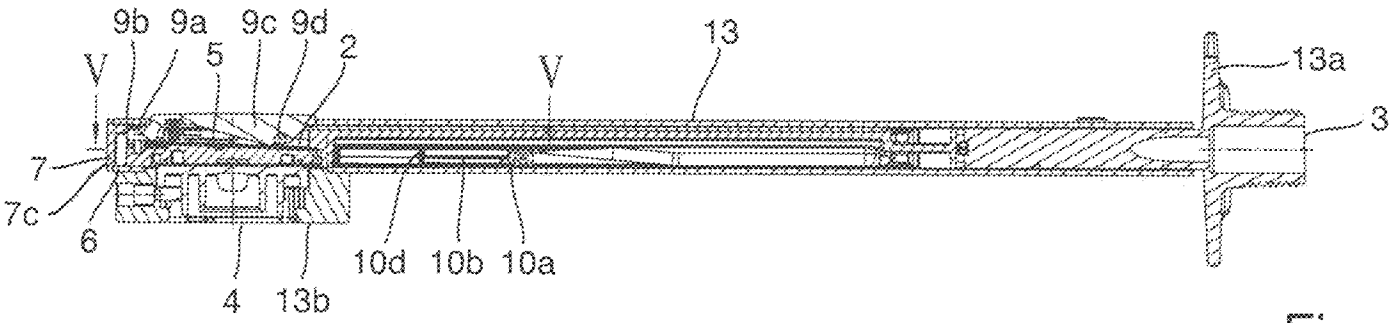
FIG. 4 shows a sectional view along a line IV-IV in FIG. 2.
Figure 5:
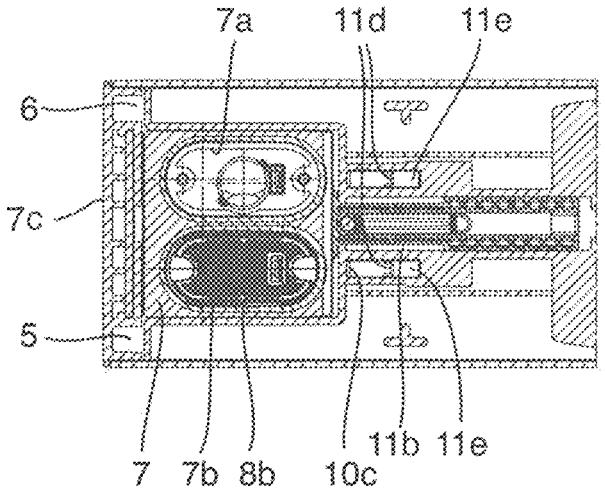
FIG. 5 shows a sectional view along a line V-V in FIG. 4.
Figure 6:
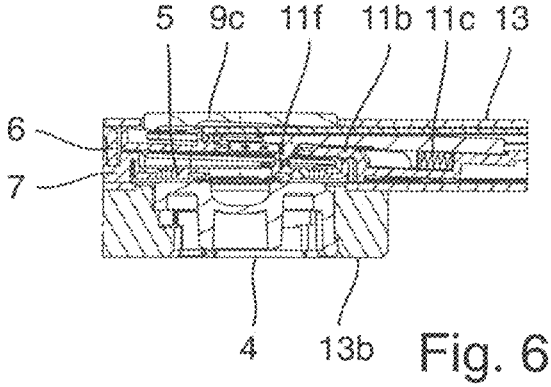
FIG. 6 shows a sectional view along a line VI-VI in FIG. 2.

Thus, FIGS. 2-19 illustrate a realization of the sanitary fitting 1 as a water outflow fitting 1*a* having a housing body 1*b* on which the insertion duct 5 is disposed. Specifically, the water outflow fitting 1*a* forms in this case a wall-mounted shower spray device 1*c*, and the housing body 1*b* is in the form of a shower housing 13, of flat design in the example shown. To be more precise, it is an overhead shower with a rectangular shower housing 13, which has, on a narrow side, a connector body 13*a* having an external thread for coupling to a wall connector of a shower water supply, such that the connector body 13*a* forms the water inlet 3. In the opposite narrow-side region, the shower housing 13 has a shower-head connector 13*b* that has on its underside, i.e. on a lower side in the mounted operating position of the shower housing 13, an attachable shower head 13*f*, which is shown only in FIG. 3, wherein the shower head 13*f*, or the mouth opening of the shower-head connector 13*b* forms the water outlet 4. In the shower housing 13, the water conduit channel 2 extends from the water inlet 3 to the water outlet 4.

In this exemplary embodiment, the insertion duct 5 is formed in the shower housing 13 at or above the shower-head connector 13*b*, wherein FIGS. 2-9 show the shower spray 1*c* with the insertion plate 7 inserted completely into the insertion duct 5. In corresponding embodiments the insertion plate 7 in this position ends with its rear face side 7*c* flush to the housing body 1*b*. Therefore, the completely inserted insertion plate 7 fits nicely and unobtrusive to the contour of the housing body 1*b*. In other words, it forms a closing termination of the insertion duct 5 at its insertion opening 6 flush with the housing body 1*b*. FIGS. 10-14 show the shower spray device 1*c* with the insertion plate 7 extracted partially from the insertion duct 5 in a water stop position, and FIGS. 15-19 show the shower spray device 1*c* with the insertion plate 7 in an ejection position extracted even further from the insertion duct 5.

In this embodiment, the shower housing 13 is oriented horizontally when it is wall-mounted in its use/operating position, and the insertion duct 5 is likewise oriented horizontally, wherein its insertion opening 6 is located at the front end side or narrow side of the rectangular shower housing 13. Thus, with the shower housing 13 mounted and the insertion duct 5 then remaining stationary in the shower housing 13, the insertion plate 7 can be inserted into the insertion duct 5 and extracted therefrom again in a horizontal direction at the front side of the shower housing 13, i.e. the lateral insertion direction SL is likewise oriented horizontally.

Figure 7:
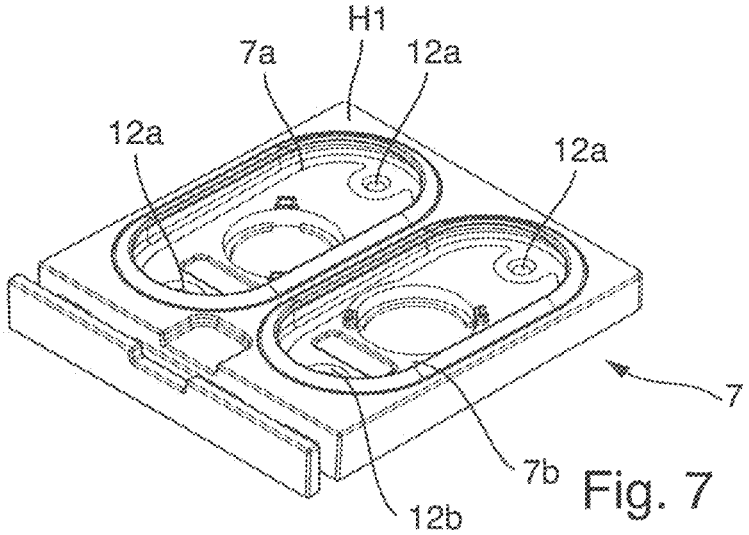
FIG. 7 shows a perspective view of the insertion plate used in the overhead shower in FIG. 2 without utility elements.
Figure 8:
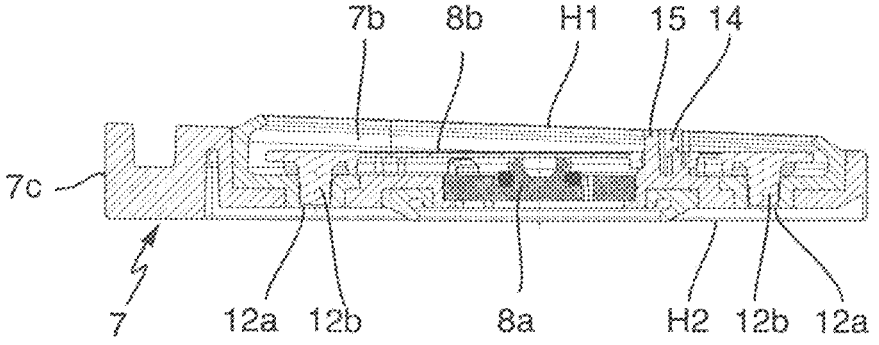
FIG. 8 shows a sectional view of the insertion plate from FIG. 7 with utility elements inserted.
Figure 9:
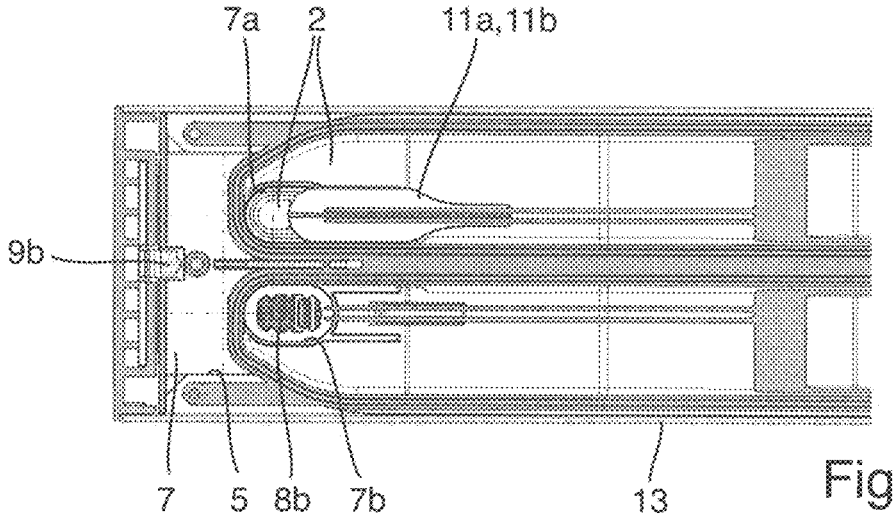
FIG. 9 shows a sectional view corresponding to FIG. 5 in a different section plane.
Figure 11:
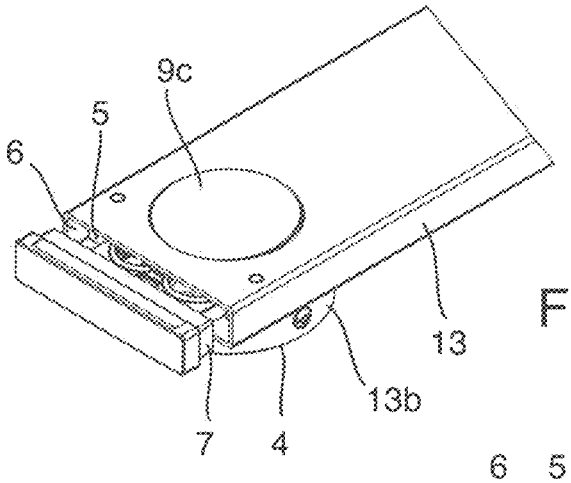
FIGS. 10-14 show views of FIGS. 2-6 with the insertion plate in a partially extracted water stop position.
Figure 13:
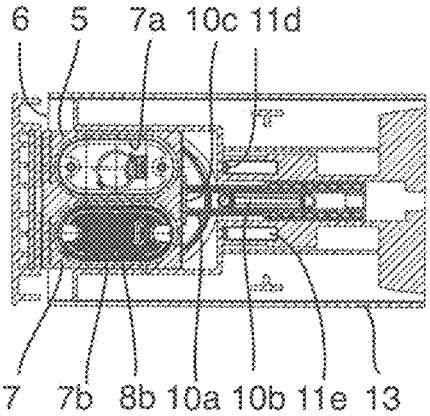
Figure 14:
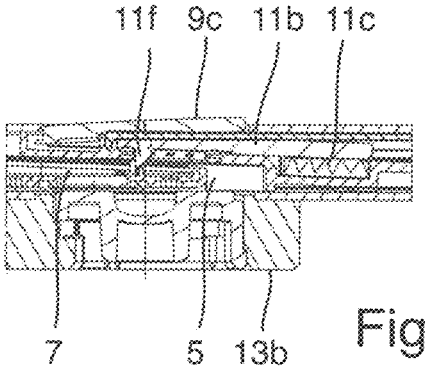
Figure 10:
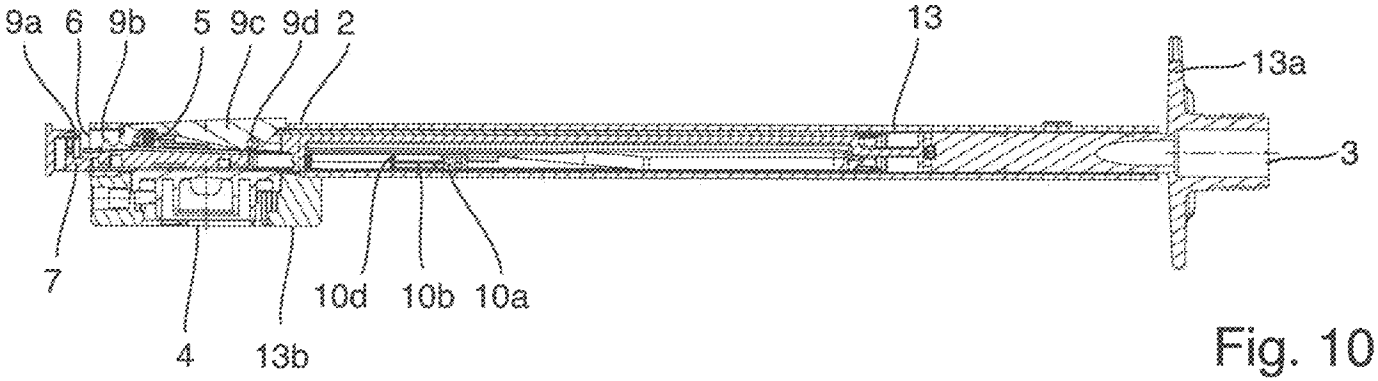
Figure 12:
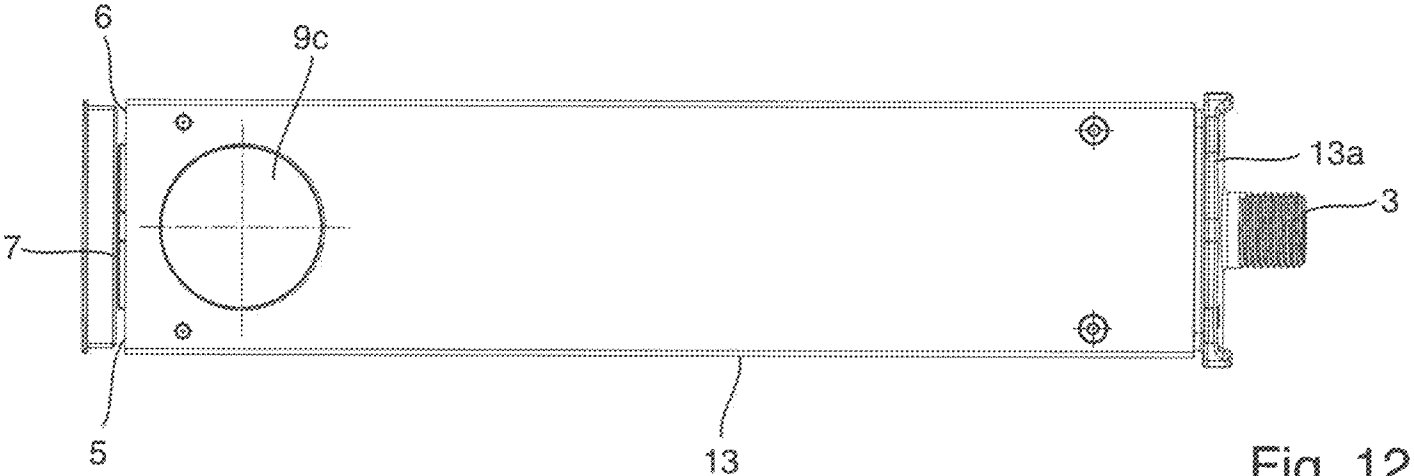
Figure 17:
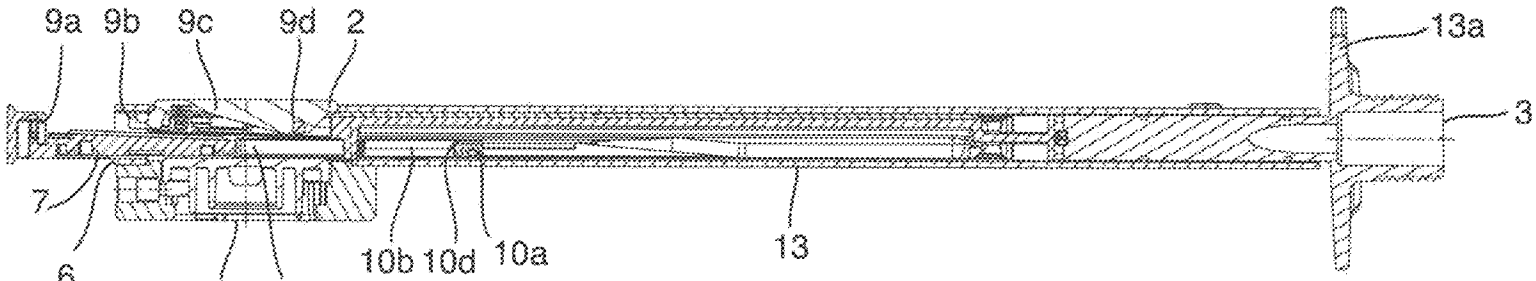
FIG. 15-19 show the views from FIGS. 10-14 with the insertion plate extracted further in an ejection position.
Figure 15:
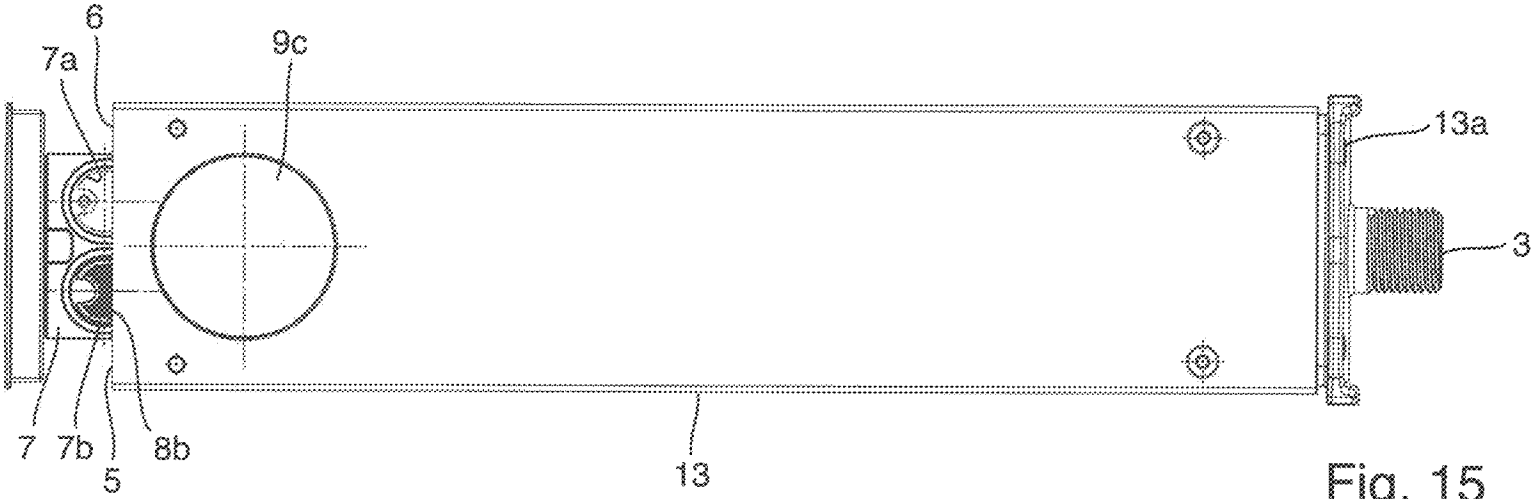
Figure 16:
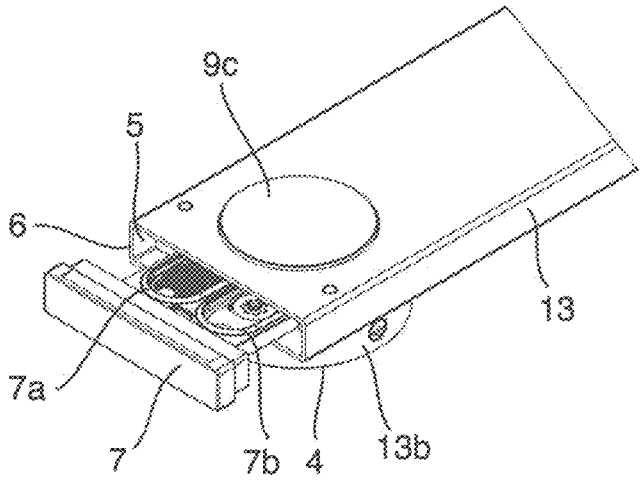
Figure 18:
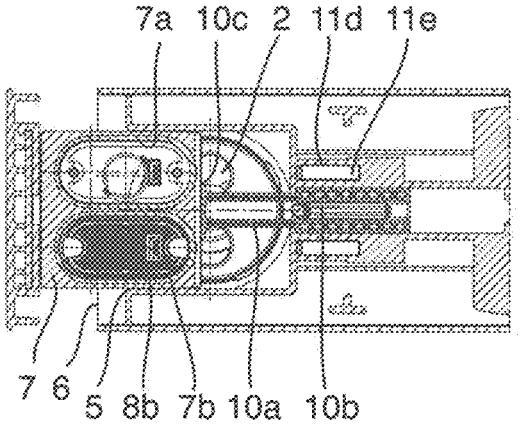
Figure 19:
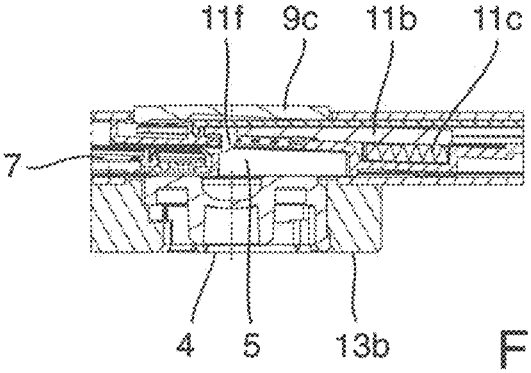

In one exemplary realization, as is shown by way of exemplary embodiment in FIGS. 2-19, the insertion plate 7 has, as shown, a cross-sectionally rectangular shape with two utility-element receptacles 7*a*, 7*b* disposed in the plate plane thereof and in juxtaposition transversely to the insertion direction SL, as are visible for example in FIG. 7. In each utility-element receptacle 7*a*, 7*b*, one or more utility elements can be received. Thus, FIG. 8 shows by way of example an example in which two utility elements, a flow limiter element 8*a* and a sieve element 8*b*, are received in the utility-element receptacle 7*b*. Thus, when the insertion plate 7 has been inserted completely into the insertion duct 5 in the operating position, these two utility elements are disposed serially in terms of flow in the water conduit channel 2, and specifically the flow limiter element 8*a* is positioned downstream of the sieve element 8*b* and close to the water outlet 4. Advantageously, the insertion plate 7 has a slight wedge shape in its thickness dimension in the flow-through direction D, i.e. the upstream main side H1 and the downstream main side H2 of the insertion plate 7 are not exactly parallel to one another but are inclined slightly with respect to one another, wherein the thickness decreases in the insertion direction SL. In this case, the downstream main side H2 is preferably parallel to the central plane EP of the insertion plate 7 or to the insertion direction SL, while the upstream main side H2 is inclined at the associated wedge angle thereto.

In the embodiment shown, the optional clip mechanism 12 is present, which comprises at least one first clip unit for holding the sieve element 8*b* in a clipped manner. This first clip unit contains clipping openings 12*a* in the insertion plate 7 and corresponding clipping protrusions 12*b* on the sieve element 8*b*. Depending on requirements, the first clip unit can be embodied so as to be non-releasable or releasable in an unsecured manner or releasable only for authorized users. If desired, the clipping openings 12*a* can act as intentional leakage openings, which form an associated water leakage path in the case of an active water supply, when the insertion plate 7 is positioned in the insertion duct 5 for example without the sieve element 8*b* or without the flow limiter element 8*a*. In this case, the water exits the housing 13 via leakage openings and thus indicates releasing of the clip unit. The sieve unit 8*b* can also be used to hold the flow limiter element 8*a* in position, by acting as a cover for the latter, said cover providing security against the flow limiter element 8*a* passing out of its receptacle in the insertion plate 7. Alternatively, a second clip unit is provided, with which the flow limiter element 8*a* is held in a clipped manner on the insertion plate 7 so as to be non-releasable or releasable in an unsecured manner or releasable only in an authorized manner.

It goes without saying that, depending on requirements and the application, different utility elements can be received in the two utility-element receptacles 7*a*, 7*b*. In the present case, only for the sake of clarity, the insertion plate 7 is shown in most figures with a still unoccupied utility-element receptacle 7*a*, while, for example, the flow limiter element 8*a* and the sieve element 8*b* according to FIG. 8 have been inserted into the other utility-element receptacle 7*b*. The two utility-element receptacles 7*a*, 7*b* can be coupled to the water conduit channel 2 in parallel or serially in terms of flow depending on requirements and the application. It also goes without saying that the insertion plate 7 can contain only one or more than two utility-element receptacles rather than the two shown.

The overhead shower configuration according to FIGS. 2-19 can additionally be equipped with the optional latching mechanism 9 and the optional ejection mechanism 10, as shown. To this end, in the realization shown, the releasable latching mechanism contains a latching cutout 9*a* disposed in the insertion plate 7, and a latching operating button 9*c* mounted on the shower housing 13 so as to be tiltable about a tilting axis 9*d*, a latching protrusion 9*b* which cooperates with the latching cutout 9*a* in a latching manner being disposed on said latching operating button 9*c*. When the insertion plate 7 is inserted into the insertion duct 5, the latching protrusion 9*b* passes automatically into the latching cutout 9*a* as soon as the insertion plate 7 has reached its operating position inserted completely into the insertion duct 5. By pressing the latching operating button 9*c*, the user can release the latched connection in that, as a result of the tilting movement of the latching operating button 9*c*, the latching protrusion 9*b* passes out of the latching cutout 9*a*.

In addition, the overhead shower configuration in FIGS. 2-19 is equipped with the optional ejection mechanism 10. In the realization shown, the latter contains an ejection slider 10*a* which is held on the shower housing 13 so as to be movable parallel to the card insertion direction SL and is supported on said shower housing 13 with interposition of an ejection spring 10*b* which biases it into the ejection position for the insertion plate 7 as per FIGS. 10-14. The ejection slider 10*a* comes to rest with its front side 10*c* against the rear narrow side of the insertion plate 7 inserted into the insertion duct 5. As a result of the introduction of the insertion plate 7 into the insertion duct 5, the ejection mechanism 10 is tensioned by the ejection slider 10*a* being pushed back counter to the force of the ejection spring 10*b*, realized here for example as a tension spring. If the user has released the latching mechanism 9, the ejection slider 10*a* pushes the insertion plate 7 outwards out of its position inserted completely into the insertion duct 5 until it reaches the ejection position. A housing-side ejection stop 10*d* limits the forward movement of the ejection slider 10*a* and thus defines the ejection position, in which the insertion plate 7 is located according to FIGS. 15-19. If the insertion plate 7 has been extracted automatically into the ejection position in such a way, it can then be removed completely from the insertion duct 5 by the user.

The overhead shower realization in FIGS. 2-19 is also equipped with the optional water stop mechanism 11 for automatically opening and closing the water conduit channel 2 when the insertion plate 7 is inserted into the insertion duct 5 and removed therefrom. To this end, the water stop mechanism 11 contains, in the example shown, a closure slider unit 11*a*, which, in a similar manner to the ejection slider 10*a*, is held on the shower housing 13 so as to be movable parallel to the card insertion direction SL. The closure slider unit 11*a* contains two closure sliders 11*b* arranged in parallel, only one of which is representatively shown in the sectional illustration in FIG. 9 and which are adapted in terms of shape, in this case a spoon-like shape, to the cross-sectional shape of the mouth openings of the water conduit channel 2 into the insertion duct 5, wherein this cross-sectional shape is for its part adapted to the cross-sectional shape of the utility-element receptacles 7*a*, 7*b* of the insertion plate 7, which form the flow-through region of the insertion plate 7 and are bordered by associated seals. The bordered seals are, according to FIGS. 7 and 8, arranged on the surface or main side H1 that is inclined as a result of the wedge shape of the insertion plate 7.

In the exemplary embodiment shown, each closure slider 11*b* has a guide cam 11*d* which is guided in a corresponding housing-side axial groove 11*e*, the front boundary of which forms a stop for the closure slider 11*b*, such that this stop defines the water stop position of the closure slider unit 11*a* according to FIGS. 10-14, in which the latter keeps the water conduit channel 2 closed. The closure slider unit 11*a* is in turn biased elastically, in a similar manner to the ejection slider 10*a*, in the direction of its advanced closed position, in which it shuts off the water conduit channel 2 downstream of the insertion duct 5, by means of a closure spring 11*c* realized here by way of example as a helical compression spring. Upon a further pushing-out movement of the insertion plate 7 out of the insertion duct 5, the closure slider unit 11*a* remains in this closed position.

When the insertion plate 7 is inserted into the insertion duct 5 beyond the water stop position and into the completely inserted operating position, it pushes the closure slider element 11*a* back and as a result shifts it from its closed position into its open position according to FIGS. 2-9. To this end, the insertion plate 7 has a protrusion 15 for pushing back the respective closure slider 11*b* and a receptacle 14 into which a front-side cam 11*f* of the respective closure slider 11*b* passes when the insertion plate 7 is inserted into the insertion duct 5, and from which said cam 11*f* passes out automatically when the insertion plate 7, starting from the water stop position, is extracted further from the insertion duct 5.

FIGS. 20-24 illustrate a realization of the sanitary fitting 1 as a water outflow fitting 1*a* having a housing body 1*b* on which the insertion duct 5 is disposed, wherein, in this case, the water outflow fitting 1*a* forms a ceiling-mounted shower spray device 1*d* and the housing body 1*b* is again configured as a shower housing. To be more precise, it is a ceiling-mounted overhead shower with a tubular shower housing 13*c*, which has, on an upper end side in the mounted position, a connector body 1*d* which is designed for ceiling mounting and contains, inter alia, the water inlet 3. On its lower end side, the shower housing 13*c*, again having an underside shower-head connector 13*b*, carries the shower head 13*f* as water outlet 4. The water conduit channel 2 extends again through the shower housing 13*c* from the water inlet 3 to the water outlet 4.

The insertion duct 5 is once again formed in the shower housing 13*c* at or above the shower-head connector 13*b*, wherein, in this case, the insertion duct 5 opens out, with its insertion opening 6, at the circumference, i.e. at the lateral surface, of the tubular shower housing 13*c*. In the mounted shower position, the insertion plate 7 can thus be inserted into the horizontally lying insertion duct 5 laterally with a horizontal insertion direction SL again. In this case, the insertion duct 5 is located, in the example shown, in the lower end-side region of the shower housing 13*c* close to the shower-head connector 13*b*.

Figure 20:
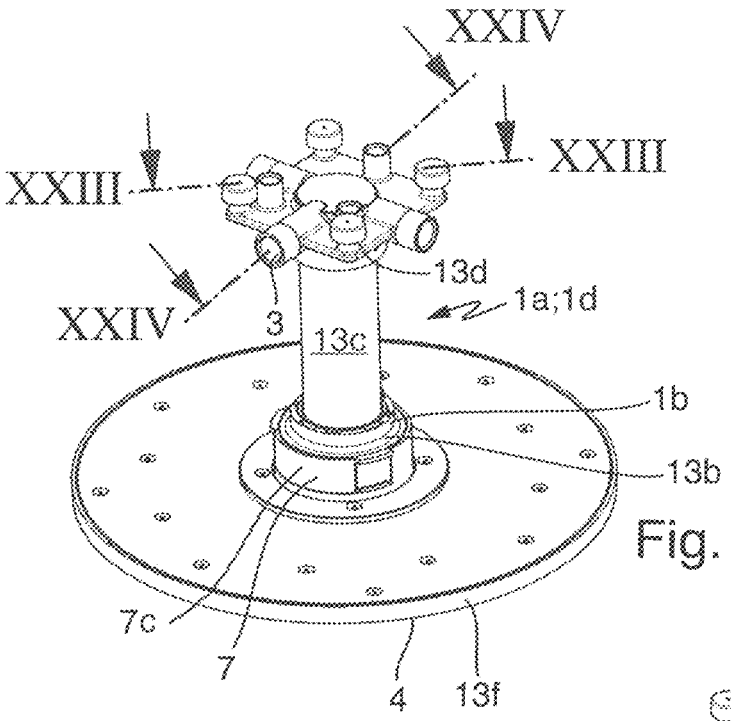
FIGS. 20-22 show perspective views of the sanitary fitting from FIG. 1 in a realization as a ceiling-mounted overhead shower with the insertion plate in the inserted operating position, water stop position and ejection position, respectively.
Figure 21:
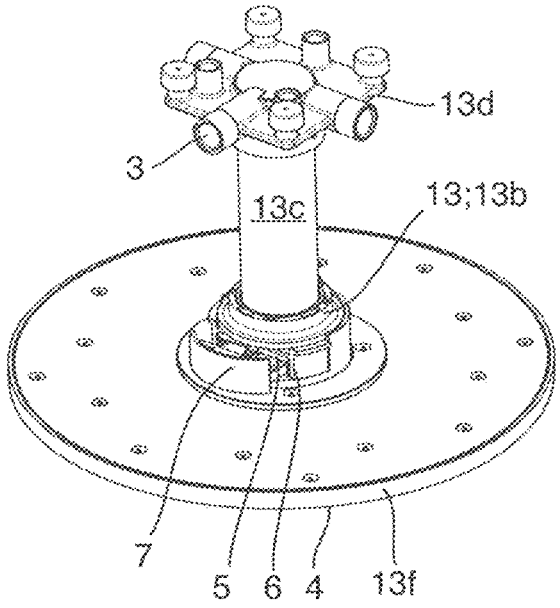
Figure 22:
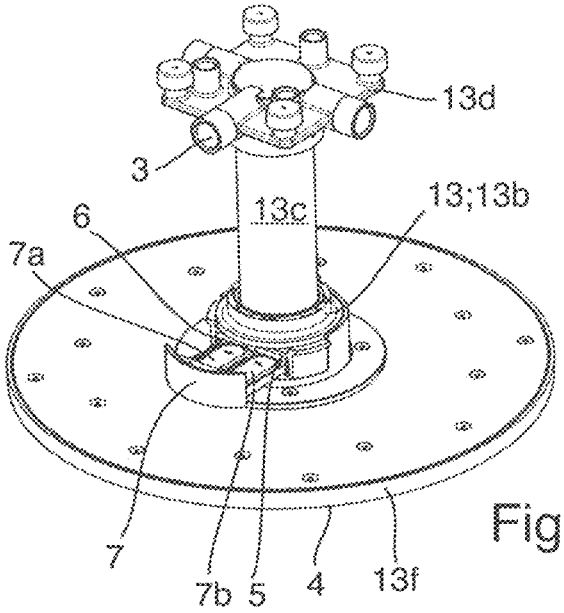
Figure 23:
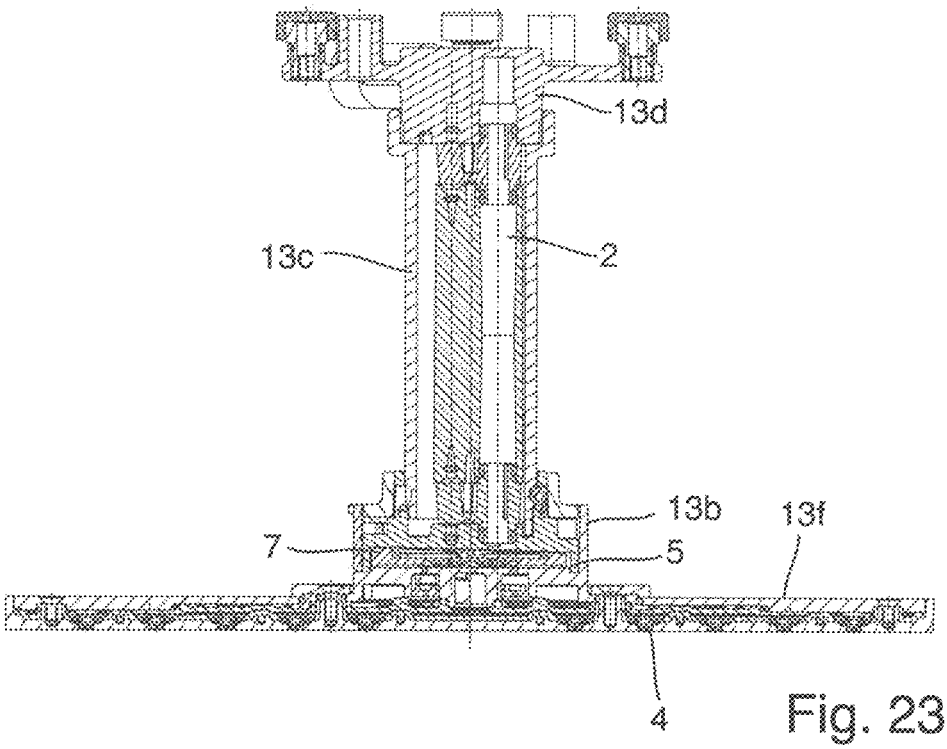
FIG. 23 shows a sectional view along a line XXIII-XXIII in FIG. 20.
Figure 24:
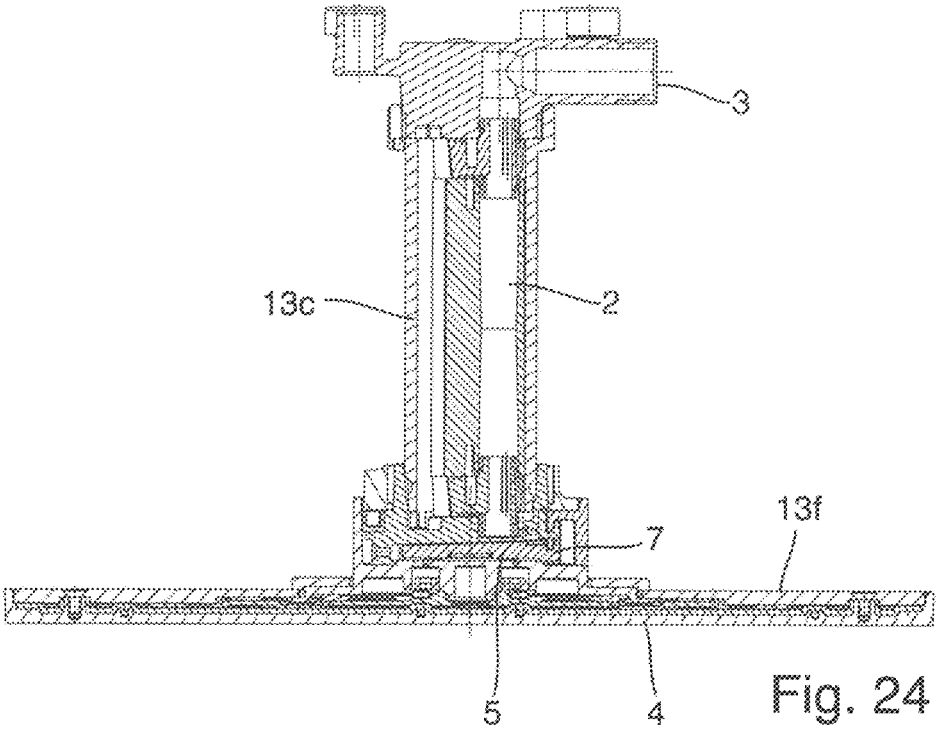
FIG. 24 shows a sectional view along a line XXIV-XXIV in FIG. 20.
Figure 25:
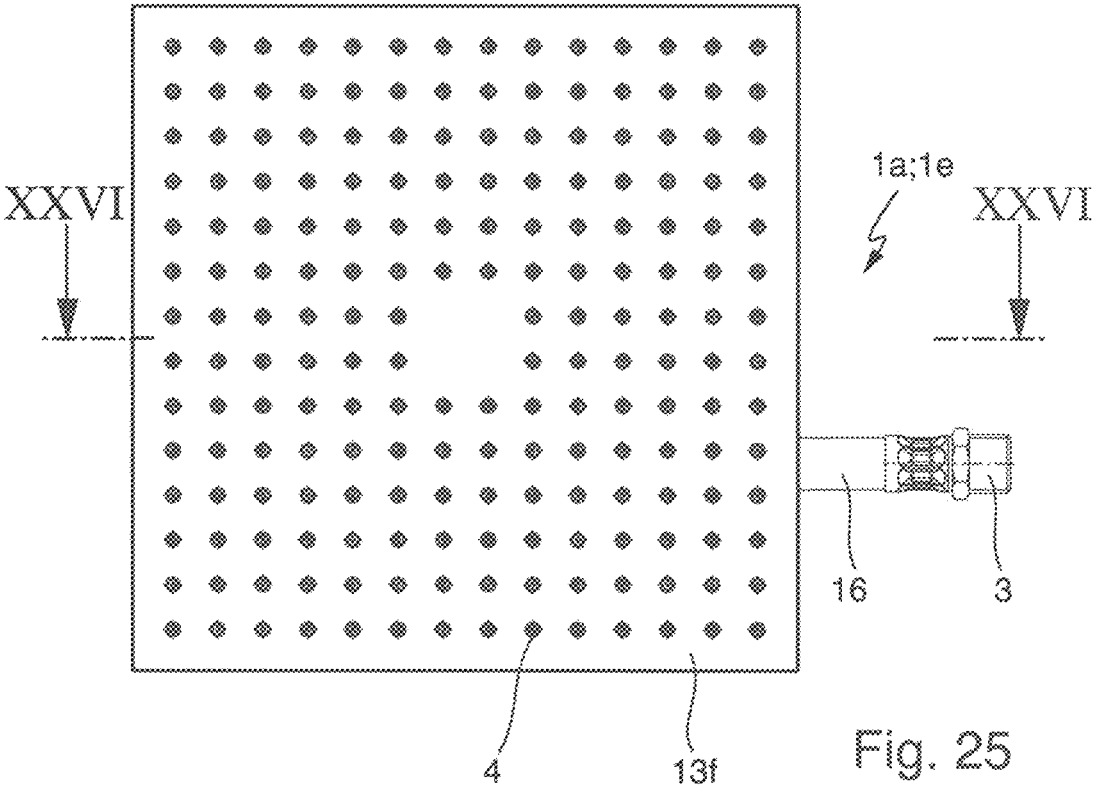
FIG. 25 shows a plan view from below of the sanitary fitting from FIG. 1 in a realization as an overhead shower mounted flush with a ceiling.
Figure 26:
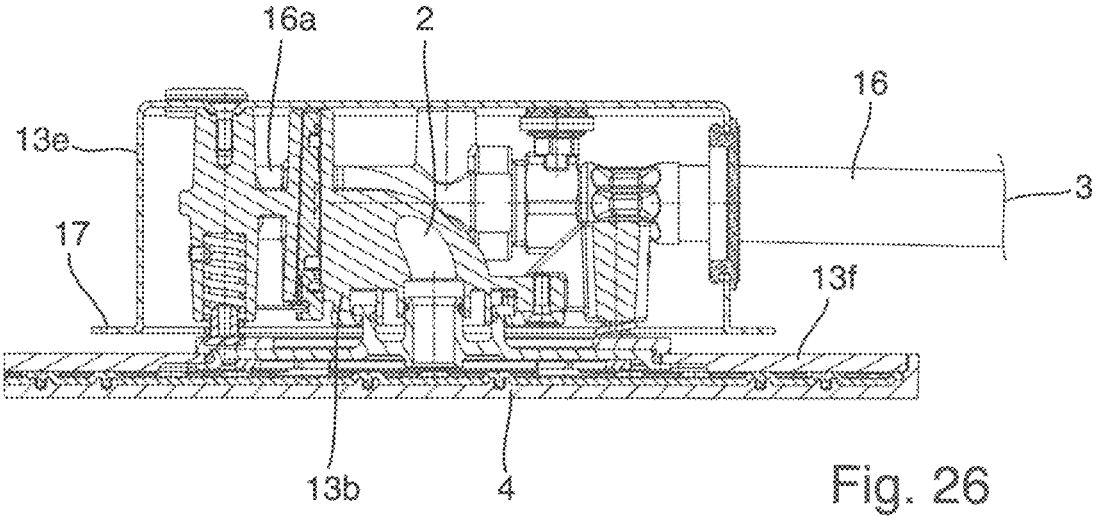
FIG. 26 shows a sectional view along a line XXVI-XXVI in FIG. 25.

FIGS. 20, 23 and 24 show the ceiling-mountable overhead shower with the insertion plate 7 inserted completely into the insertion duct 5. FIGS. 21 and 22 show the overhead shower with the insertion plate 7 in the water stop position or in the ejection position corresponding to the situation according to FIGS. 10-14 and 15-19, respectively, in the exemplary embodiment in FIGS. 2-19. For the insertion duct 5 and the insertion plate 7, and for the optional parts, such as the latching mechanism 9, ejection mechanism 10 and water stop mechanism 11, the realizations explained above with respect to the exemplary embodiment in FIGS. 2-19 are usable in the same way for the ceiling-mountable overhead shower in FIGS. 20-24. In this regard, reference can be made to the above description thereof.

For the functions, possible realizations and advantages of the insertion plate 7, which can again act like being a service card, the above details given with respect to the exemplary embodiment in FIGS. 2-19 likewise apply in a corresponding manner to the exemplary embodiment in FIGS. 20-24.

FIGS. 25-28 illustrate a realization of the sanitary fitting 1 as a water outflow fitting 1*a* having a housing body 1*b*, on which the insertion duct 5 is disposed, wherein, in this case, the water outflow fitting 1*a* forms a shower spray 1*e* built into a ceiling and the housing body 1*b* is configured as a cup-shaped shower housing 13*e*. The cup-shaped shower housing 13*e* is mounted with its open side downwards and with an associated peripheral region 17 preferably substantially flush with the ceiling of a shower room or bathroom. Laterally, a supply line 16 leads into the shower housing 13*e*, said supply line 16 forming the water inlet 3. On the lower side, in the mounted position, of the shower housing 13*e*, the shower head 13*f* forming the water outlet 4 is coupled to the shower-head connector 13*b*, wherein, in this configuration, as also in the other configurations, the shower head 13*f* can be secured to the shower housing 13*e* preferably in a releasable manner, for example by means of a plug connection, latching connection or clip connection. In the shower housing 13*e*, the water conduit channel 2 again extends from the water inlet 3 to the water outlet 4.

Figure 27:
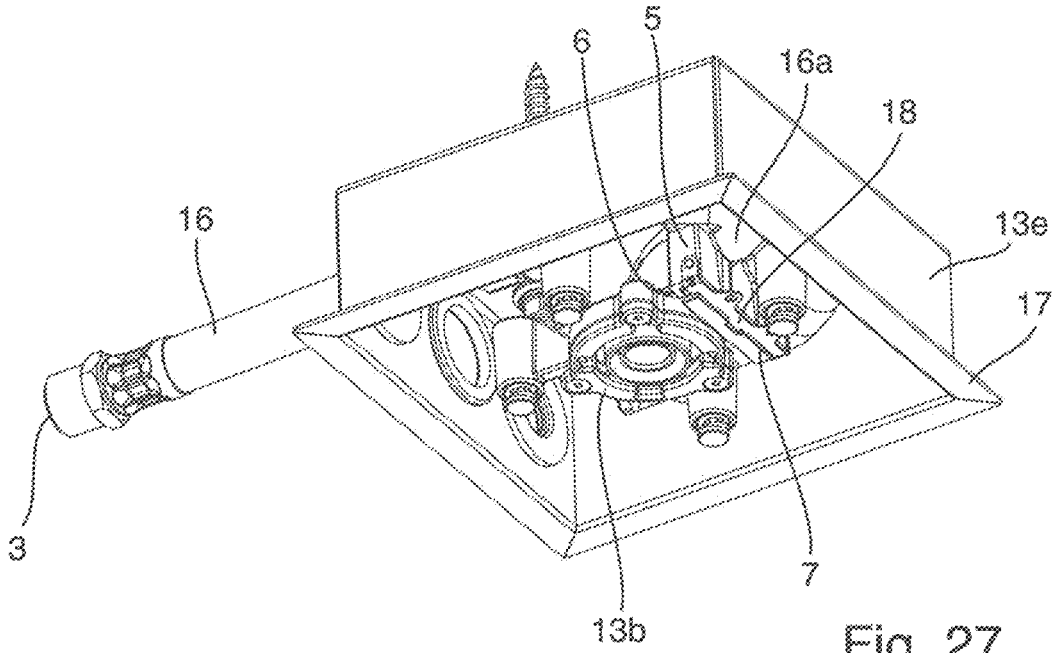
FIG. 27 shows a perspective view of the overhead shower from FIG. 25 with the shower head removed and with the insertion plate inserted.
Figure 28:
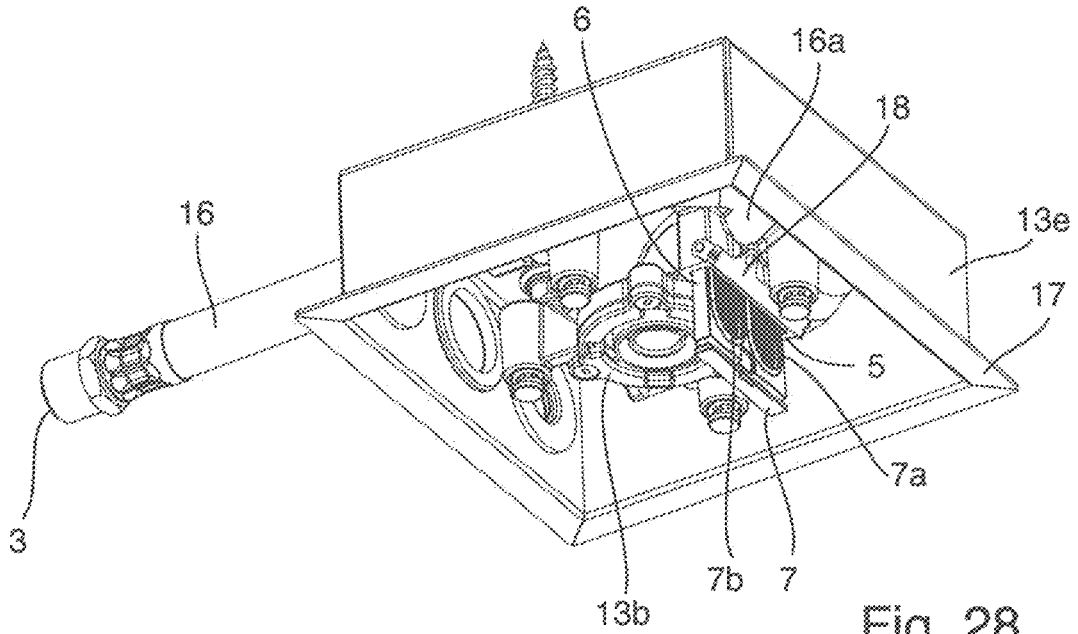
FIG. 28 shows the perspective view from FIG. 27 with the insertion plate extracted.

FIGS. 27 and 28 show the shower spray device 1*e* built into the ceiling with the shower head 13*f* removed. In these views, the insertion duct 5 once again formed in the shower housing 13*e* and the associated insertion plate 7 can be seen. As is apparent therefrom, in this case, when the overhead shower built into the ceiling is in its mounted position, the insertion duct 5 extends in a vertical direction with a downwardly directed insertion opening 6. Accordingly, the insertion plate 7 can be inserted into the insertion duct 5 from the bottom upwards with a vertical insertion direction SL. FIG. 27 shows the insertion plate 7 in a position completely inserted into the insertion duct 5 and additionally secured in this position by means of a pivotable securing bracket 18. FIG. 28 shows the insertion plate 7 in the ejection position with the securing bracket 18 pivoted away.

The insertion duct 5, and the insertion plate 7 inserted therein, are able to have horizontal flow through them in this exemplary embodiment. To this end, in continuation of the supply line 16, a line run extends in the shower housing 13*e* in a line arc 16*a* to one side of the insertion duct 5, or of the insertion plate 7, in FIG. 26 the left-hand side and in FIGS. 27 and 28 the right-hand side, while the opposite side of the insertion duct 5, or of the insertion plate 7 is adjoined by a downstream water conduit, which is formed in the shower housing 13*e* and continues the water conduit channel 2 as far as the shower head 13*f* and the water outlet 4 there.

For the insertion duct 5 and the insertion plate 7 and also the optional parts, such as the latching mechanism 9, ejection mechanism 10 and water stop mechanism 11, which can also be provided in the exemplary embodiment in FIGS. 25-28 if required, the functionalities and advantages specified above with respect to the exemplary embodiment in FIGS. 2-19 again apply in the same way.

When the shower spray device 1*e* built into the ceiling is fully mounted in its operating position, the insertion duct 5 and the insertion plate 7 are concealed by the shower head 13*f*. In order to introduce the insertion plate 7 into the insertion duct 5 and remove it therefrom, therefore, the shower head 13*f* fastened releasably to the cup-shaped shower housing 13*e* is removed from the shower housing 13*e* beforehand. When the insertion plate 7 has been inserted into the insertion duct 5, the shower head 13*f* can be attached to the shower housing 13*e* again.

As the exemplary embodiments shown and mentioned above make clear, the invention advantageously provides a sanitary fitting in which one or more sanitary utility elements can be introduced into or removed from a water conduit channel of the sanitary fitting by means of an insertion plate that is insertable into an insertion duct. The insertion plate can act as it were as a service card, with which utility elements that are desired in each case can be introduced into the water conduit channel and as a result be brought into contact with the water flowing there. In addition to the examples already mentioned, further components are usable as sanitary utility element, depending on requirements and the application, for instance an aerator element, an overpressure protection element, a water analysis element having test strips for determining water hardness, chlorine content, degree of turbidity, number of bacteria and/or pH, etc., a pulsator element having a pressure pulsing diaphragm for creating a pulsating water jet, a sensor element for sensing desired physical parameters of the water, a scald protection element, for example having a flappable bimetallic strip for the temperature-dependent opening and closing of the water flow channel, a maintenance display element with a timer and/or sensor for indicating maintenance becoming due, a filter element or a jet forming element for providing a desired shower jet characteristic. The insertion plate can also be used to store small parts which are required for the sanitary fitting.

Advantageously, a plurality of insertion plates of the same type can be provided, which can be inserted selectively into the same insertion duct of a sanitary fitting in question and contain different utility elements, for example those with differently fine sieve elements or different filter elements or different sanitary utility functions.

Although the invention has been described in detail with reference to certain preferred embodiments, variations and modifications exist within the spirit and scope of the invention as described and defined in the following claims.

The invention claimed is:

1. A sanitary fitting, comprising:

a water conduit channel, an insertion duct transversely extending into the water conduit channel and including a user-accessible insertion opening, and an insertion body which includes at least one sanitary utility element, has flow-through capability in a flow-through region from a first side to an opposing second side, and is insertable into the insertion duct and extractable from the insertion duct, wherein the insertion duct remains stationary in an operating position, when the insertion body is inserted or extracted, and the insertion opening remains user-accessible in the stationary operating position of the insertion duct, wherein the insertion body has its flow-through region positioned in the water conduit channel and the at least one sanitary utility element is in contact with the water conduit channel, when the insertion body is located in its operating position completely inserted in the insertion duct, and wherein the insertion body is formed as an insertion plate which has flow-through capability in the flow-through region from a first plate main side to a second plate main side, the insertion plate has a smaller plate thickness as compared to a lateral plate dimension and is insertable in a lateral insertion direction into the insertion duct and extractable form the insertion duct counter the insertion direction.

2. The sanitary fitting according to claim 1, wherein the at least one sanitary utility element is at least one of a sieve, a flow limiter, a jet forming body, a water aerator element, or a water additive element.

3. The sanitary fitting according to claim 1, wherein the plate thickness of the insertion plate comprises in the flow-through direction a wedge shape with decreasing thickness in the insertion direction, and comprises a seal at an inclined surface corresponding to the wedge shape.

4. The sanitary fitting according to claim 1, further comprising a releasable latching mechanism for latched holding the insertion plate in the insertion duct.

5. The sanitary fitting according to claim 4, further comprising an ejection mechanism for automatic extracting of the insertion plate form its operating position in the insertion duct after releasing the latching mechanism.

6. The sanitary fitting according to claim 1, further comprising a water stop mechanism for automatic opening and closing of the water conduit channel during insertion of the insertion plate into and removal from the insertion duct.

7. The sanitary fitting according to claim 6, wherein the water stop mechanism includes a closure slider unit elastically biased in the closing direction and actuated by the insertion plate for opening and closing the water conduit channel upstream of the insertion duct.

8. The sanitary fitting according to claim 1, further comprising a clip mechanism for clipped holding of the utility element on the insertion plate.

9. The sanitary fitting according to claim 1, wherein the insertion plate comprises a plurality of utility elements arranged in juxtaposition in a plate plane of the insertion plate.

10. The sanitary fitting according to claim 1, wherein the insertion plate comprises a plurality of utility elements arranged in succession in flow-through direction.

11. The sanitary fitting according to claim 1, wherein it is a water outlet fitting having a housing body on which the insertion duct is disposed.

12. The sanitary fitting according to claim 11, wherein the insertion plate has a rear face side which ends flush with the housing body of the water outlet fitting when the insertion plate is in its operating position completely inserted into the insertion duct.

13. The sanitary fitting according to claim 11, wherein a shower spray device is mounted in a projecting manner to a wall or ceiling, having a shower housing on which the insertion duct is disposed.

14. The sanitary fitting according to claim 1, wherein a shower spray device is built into a wall or ceiling, and wherein the insertion duct is disposed with an insertion direction oriented perpendicular to a wall or ceiling installation plane.

* * * * *